United States Patent [19]

Brokaw

[11] Patent Number: 4,493,436

[45] Date of Patent: Jan. 15, 1985

[54] COMPARTMENTAL CARTRIDGE

[75] Inventor: Paul Brokaw, Cleveland, Ohio

[73] Assignee: Loctite Corporation, Newington, Conn.

[21] Appl. No.: 475,877

[22] Filed: Mar. 16, 1983

[51] Int. Cl.[3] ..... B67D 5/52

[52] U.S. Cl. ..... 222/80; 222/137

[58] Field of Search ..... 222/80, 94, 95, 129, 222/136, 137, 145, 325–327, 386; 83/54, 191; 221/30

[56] References Cited

U.S. PATENT DOCUMENTS

| | | | |
|---|---|---|---|
| 3,007,611 | 11/1961 | Coolidge | 222/137 |
| 3,266,671 | 8/1966 | Gelpey | 222/137 X |
| 3,323,682 | 6/1967 | Creighton, Jr. et al. | 222/137 X |
| 3,620,417 | 11/1971 | Simms | 222/136 |

FOREIGN PATENT DOCUMENTS

| | | | |
|---|---|---|---|
| 2521392 | 11/1976 | Fed. Rep. of Germany | 222/137 |
| 2082686 | 3/1982 | United Kingdom | 222/137 |

*Primary Examiner*—Joseph J. Rolla
*Assistant Examiner*—Kevin P. Shaver
*Attorney, Agent, or Firm*—Perman & Green

[57] ABSTRACT

A cartridge for simultaneously dispensing at least two different materials includes an elongated hollow housing having at least one partition extending laterally and longitudinally thereof to provide at least two chambers for holding the respective materials. A plunger sliding within the housing severs or slits the partition so that it can be stored during operation outside of the respective chambers. The partition may be coiled up or it may be directed laterally around the plunger so that it is stored adjacent an internal wall of the housing.

25 Claims, 8 Drawing Figures

COMPARTMENTAL CARTRIDGE

BACKGROUND OF THE INVENTION

This invention relates to a compartmental cartridge for dispensing measured amounts of viscous materials. Such materials could include, for example, two component reactant silicone materials, two component epoxy adhesives, or other multi-component materials as are known in the art.

Multi-component cartridges have been commercially used. Such cartridges have typically employed twin syringes, or in the industrial area, a cartridge is known having a divider strip which is operated by twin plungers within the cartridge. This latter package requires special application hardware which is why it is limited to industrial applications. Another alternative which is known in the art is the use of a pair of bags within the cartridge and the use of a single plunger which compresses both bags simultaneously, such as illustrated in U.S. Pat. No. 3,323,682. This approach has not proven very successful since it is rather crude and is subject to viscosity variations between the components in each of the bags which would interfere with the uniformity of delivery of each of the components.

In yet another approach, a single plunger is employed which directly forces one of the products or materials through an outlet and flattens the separating membrane so as to compress the other material out of the separate discharge port or outlet. This approach is illustrated in U.S. Pat. No. 3,266,671.

U.S. Pat. No. 3,007,611 discloses a dual component dispenser having a tear foil overlying a slot provided in a wall which defines a pair of divided compartments. As the plunger is moved towards the discharge end, the foil is torn by the downward movement of the plunger. The torn or separated portion of the foil, however, remains within the filled section of one of the compartments. The problem with this approach is that the foil is torn by the forward face of the plunger and, therefore, if it does not tear properly, there is the possibility of losing the integrity of the seal between the respective compartments.

Accordingly, the invention disclosed herein provides a cartridge for simultaneously dispensing at least two different materials in desired amounts which is inexpensive, reliable and maintains the materials separate from one another until they are fully dispensed from the cartridge.

SUMMARY OF THE INVENTION

In accordance with this invention, a cartridge is provided for simultaneously dispensing at least two different materials in respectively desired amounts. The cartridge comprises an elongated hollow housing having at least one partition within it extending laterally and longitudinally to divide the housing into at least two chambers each for holding one of the different materials. A plunger is arranged in the housing for movement longitudinally thereof. The housing includes a dispensing orifice for each of said chambers. In use, the cartridge is normally inserted in or includes a device for moving the plunger longitudinally of the housing to dispense the materials through the orifice. In accordance with this invention, the plunger comprises a piston means having a first face for acting on materials to dispense them from the housing. The piston means includes a means for sealingly engaging both the housing and the partition.

In accordance with one embodiment of the invention, a severing means following the piston means and, which is spaced from the materials being dispensed by the piston means, is provided. The severing means is adapted to sever the partitions from the housing and means are then provided for storing the severed partition so as not to interfere with the operation of the cartridge. In accordance with an alternative embodiment of the invention, in place of the means for storing and severing the partition, a means is provided for directing the severed partition into an unoccupied space within the housing so as not to interfere with the operation of the cartridge. In accordance with yet still another embodiment of the invention, the partition is not severed from the housing, but rather it is slit into at least two parts by a slitting means in place of the previously described severing means. Means are then provided for folding and directing the parts of the partition, after slitting, into an unoccupied space within the housing so as not to interfere with the operation of the cartridge.

The severing or slitting means preferably comprise a push ring having one or more cutting edges for either severing or slitting the partition. The push ring is arranged to support a second face of the piston means opposing the first face. The push ring may serve as a container for storing the severed partition. Alternatively, it can serve to guide the severed partition laterally around the push ring into a position adjacent an internal wall of the housing. In the last mentioned embodiment of the invention, the push ring includes guides for folding respective halves of the partition and for directing them adjacent the internal wall of the housing.

Preferably, the push ring is coated with a release agent to provide free movement within the housing. Preferably, the partition is thinned out in the regions where it is to be cut. Preferably, the push ring is formed of a material which is harder than the material forming the partition.

DETAILED DESCRIPTION OF THE PREFERRED EMBODIMENTS

Figure 1:
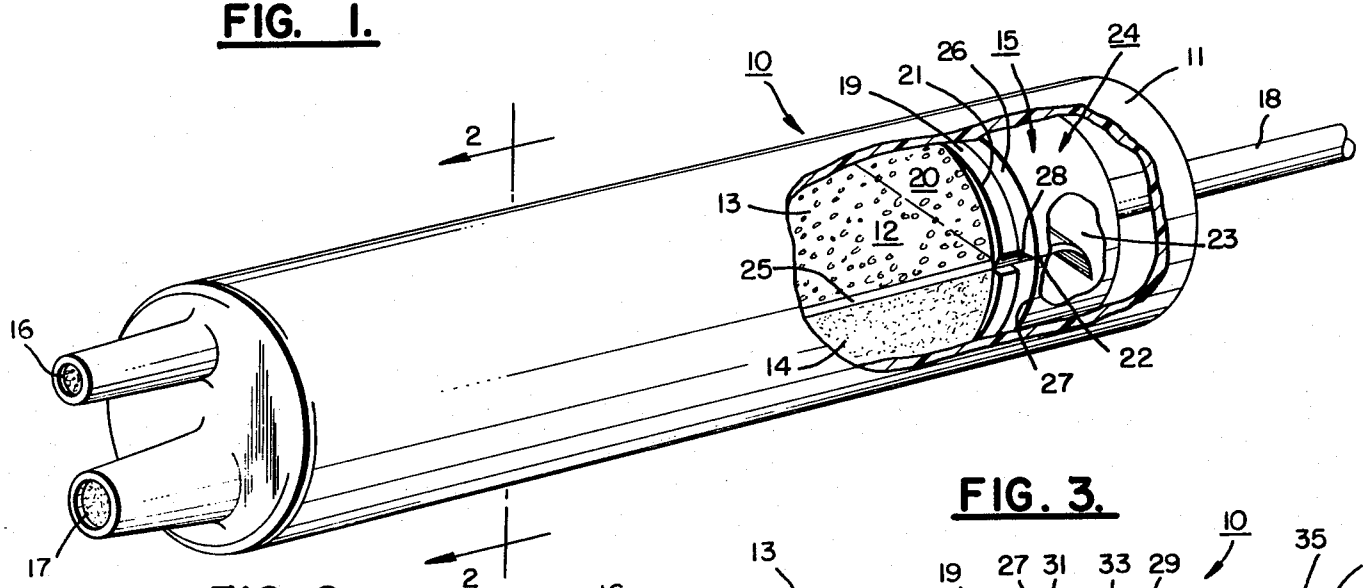
FIG. 1 is a perspective view, which has been partially cut away, of a cartridge in accordance with one embodiment of this invention.
Figure 3:
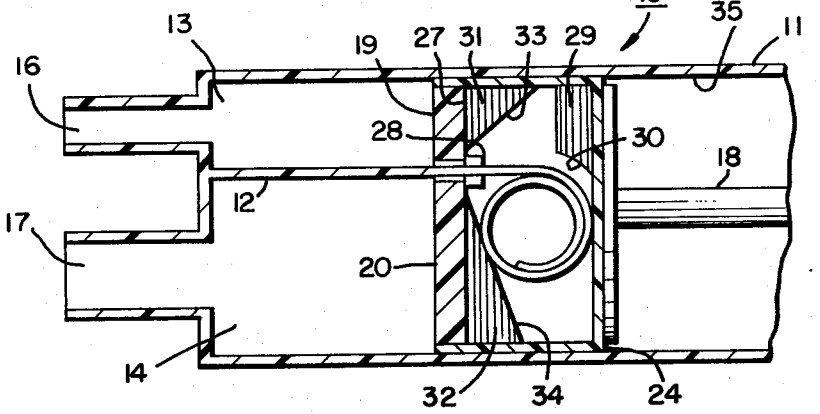
FIG. 3 is a cross-sectional view of a cartridge in accordance with an embodiment of this invention.
Figure 2:
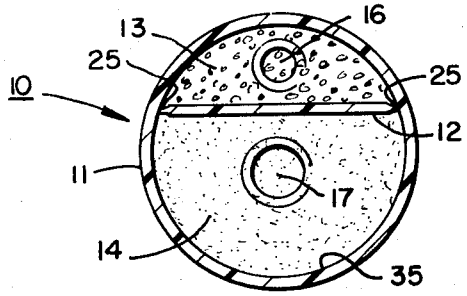
FIG. 2 is a sectional view along the line 2—2 in FIG. 1.

Referring now to FIGS. 1–3, a cartridge for simultaneously dispensing at least two different materials in accordance with one embodiment of this invention will be described. The cartridge 10 comprises elongated hollow housing 11. At least one partition 12 is arranged within the housing and extends laterally and longitudinally thereof to divide the housing 11 to at least two chambers 13 and 14. Each of the chambers 13 and 14 is adapted to support or hold one of the different materials. A plunger 15 is arranged in the housing for movement longitudinally thereof. The housing includes dispensing orifices or spouts 16 and 17, one communicating with each of the chambers 13 and 14. The inside diameter of the orifices can be suitably adjusted to balance the internal pressure of the two materials being dispensed.

The cartridge 10 is adapted for insertion in a suitable actuating mechanism including a means 18 for moving the plunger 15 longitudinally of the housing to dispense materials through the orifices 16 and 17. Alternatively, as desired, the plunger moving means 18 can be connected to the plunger 15 so that the cartridge 10 is fully operational by itself.

In accordance with this invention, the plunger 15 comprises a piston means 19 having a first face 20 for acting on the materials to be dispensed in order to push them out of the housing 11. The piston means 19 includes means 21 comprising the edges of the piston means 19 for sealingly engaging the piston means 19 to both the housing 11 and the partition 12.

In accordance with this embodiment of the invention, a severing means 22 follows the piston means 19. The severing means 22 is spaced from the materials being dispensed by the piston means 19. Therefore, the compartments 13 and 14 are completely sealed by the edges 21 of the piston means before the partition 12 is severed. This provides a reliable seal between the respective compartments preventing intermixing of the respectively different materials prior to their dispensing from the cartridge 10. The severing means 22 is adapted to sever the partition 12 completely from the housing 11. In accordance with this invention, storing means 23 are provided for storing the severed partition in a manner which does not interfere with the operation of the cartridge.

Preferably, the severing means 22 comprises a push ring 24 having a cutting edge 22 at each longitudinal edge 25 of the partition 12. The push ring 24 is arranged to support a second face 26 of the piston means 19 which is arranged opposing the first face 20. The push ring 24 further comprises a container for storing said severed partition. The plunger moving means 18 is adapted to either engage or be connected to the push ring 24.

Preferably, the partition 12 has a given thickness except at the longitudinal edges which are thinned out from the given thickness. Preferably, the push ring 24 is coated with a release agent, such as wax, to provide free movement within the housing 11. Preferably, the push ring 24 is formed of a material which is harder than the material of the partition. The push ring 24 preferably includes a forward wall 27 having a slot 28 therein through which severed partition 12 is adapted to pass.

It is a unique aspect of this embodiment of the invention that means 29 are provided within the push ring 24 for coiling up or rolling up the partition 25 after it has been severed from the housing 11. The coiling means 29 comprises a guide block within the push ring 24 having an arcuate surface 30. The arcuate surface 30 deflects the partition 12 to curve it into the desired coiled arrangement as shown in FIG. 3. Additional guide blocks 31 and 32 having inclined surfaces 33 and 34 aid in the coiling operation. While it is preferred that the severed partition 25 be coiled as in FIG. 3, it may be retained in the compartment or container defined by the push ring 24 in any desired manner such as by being crushed or folded.

The inside diameters of the orifices 16 and 17 are designed to equalize the internal pressures of the materials in the respective chambers 13 and 14 as they are being forced from the cartridge 10. The edge sealing means 21 is designed to eliminate the possibility of the materials in the chambers 13 and 14 from reaching the push ring 24.

In operation, as the push ring 24 is urged towards the orifices 16 and 17, the cutting edges 22 sever the partition 12 from the internal wall 35. The severing operation occurs after the partition 12 has passed through the piston means 19 which maintains an effective seal of the respective chambers 13 and 14 throughout the operation of the cartridge. After the partition 12 is fully severed from the housing 11, it is coiled, folded or crushed within the compartment defined within the push ring 24.

Figure 4:
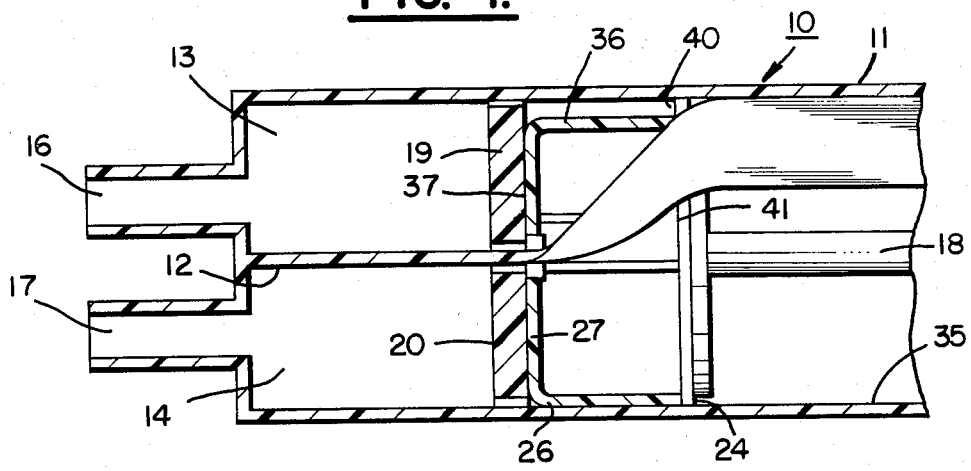
FIG. 4 is a cross-sectional view of a cartridge of yet another embodiment of this invention.
Figure 5:
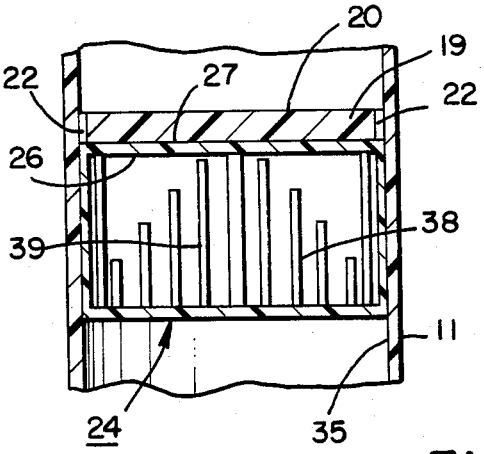
FIG. 5 is a partial top cross-sectional view of the cartridge of FIG. 4.

Referring now to FIGS. 4 and 5, an alternative embodiment of a cartridge 10 in accordance with this invention will be described. Like elements as in the previous embodiment are given corresponding reference numbers. This embodiment of the invention differs from the one which was previously described in the design of the push ring 24. Instead of a storing means 23, a means 36 is provided for directing the severed partition 12 into an unoccupied space within the housing 11 in a manner which does not interfere with the operation of the cartridge 10. The push ring 24 includes cutting edges 22, as in the previous embodiment, for severing the partition 12 from the housing 11. Preferably as shown, the push ring also includes a central cutting edge 37 which serves to divide the partition 12 into two parts. Oppositely inclined guide blocks 38 and 39 are supported by the push ring to deflect the respective parts of the partition 12 laterally toward the internal wall 35 of the cartridge 10. The upper edge 40 of the back wall 41 of the push ring 24 is spaced from the internal wall 35 to allow the split partition 12 to pass around the push ring 24 so that it is stored adjacent the internal wall 35.

While it is preferred to divide the partition 12 into at least two parts as described by reference to the embodiment of FIGS. 4 and 5, if the partition 12 is sufficiently flexible, it need not be divided and the cutting edge 37 could be eliminated. In such an approach, it would be guided by the oppositely inclined guide portions 38 and 39 of the push ring 24 into its storage position adjacent the internal wall 35. Except for the differences just described, cartridge 10 of the embodiment of FIGS. 4 and 5 enjoys the same benefits and features as the embodiment described by reference to FIGS. 1–3. In particular, the piston means 19 serves to seal the chambers 13 and 14 prior to the partition 12 being severed from the housing 11.

Figure 7:
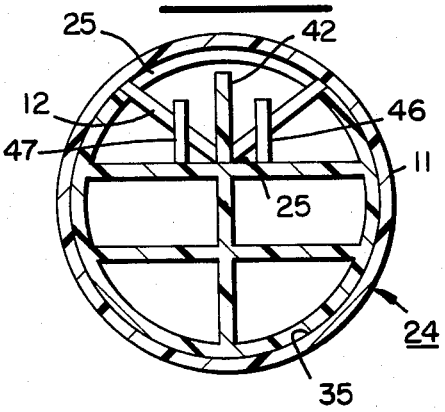
FIG. 7 is a cross-sectional view along the line 7—7 in FIG. 6.
Figure 6:
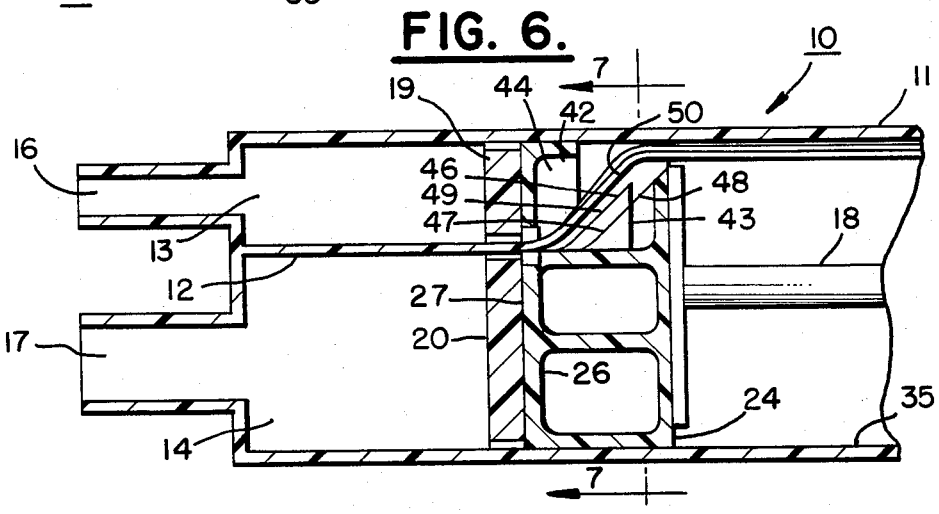
FIG. 6 is a cross-sectional view of a cartridge in accordance of yet another embodiment of the invention.
Figure 8:
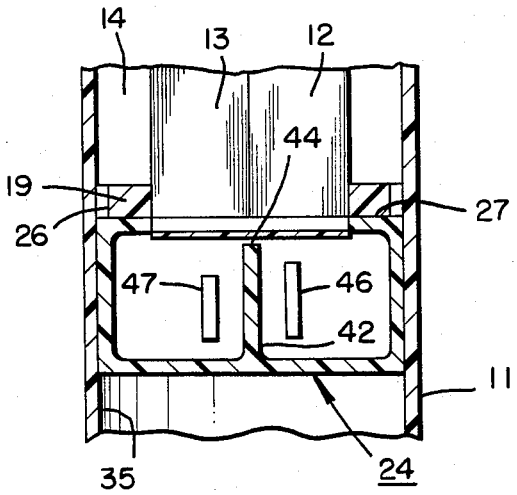
FIG. 8 is a partial top cross-sectional view of the cartridge of FIG. 6.

Referring now to FIGS. 6–8, yet another embodiment of a cartridge 10 in accordance with the present invention will be described. Like elements have been given the same reference numeral as in the previously described embodiments. The difference between the embodiment shown in FIGS. 6–8 and those previously described is again with reference to the push ring 24. In accordance with this embodiment of the invention the partition 12 is not severed from the housing 11. In place of the severing means 22, a slitting means 42 is provided for slitting the partition 12 into at least two parts which remain attached to the housing 11 at the respective longitudinal edges 25.

This embodiment of the invention is particularly adapted for use with partitions 12 which do not have a planar shape. In fact they may have any desired shape, as, for example, a V-shape shown in FIG. 7. Alternatively, it could have an arcuate shape or be U-shaped, as desired. Means 43, also supported by the push ring 24, is provided for folding and directing the slit portions of the partition 12 into a unoccupied space within the housing 11 in a manner which does not interfere with the operation of the cartridge 10.

The slitting means 42 is supported by the push ring 24 and has at least one cutting edge 44 for slitting the partition 12 longitudinally and along a line intermediate the longitudinal edges 25. The slitting means 42, in the embodiment shown, slits the partition 12 approximately in half at the vertex 45 of the partition 12.

The means 43 for folding and directing the slit parts of the partition 12 comprises a means 46 for first folding a first half of the partition 12 and a means 47 for then folding the other half of the partition 12. This is so that the respective halves of the partition 12 are directed in an overlapped folded relationship around the periphery of the push ring 24 whose upper edge 48 is spaced from the internal wall 35. Thereby, the respective halves of the partition 12 are stored adjacent the internal longitudinal wall 35 of the housing 11.

Respective means 46 and 47 for serially folding the slit portions of the partition 12 comprise inclined guide blocks with the inclined surface 49 of the guide block 47. The displacement of the folding means 46 relative to the folding means 47 accounts for this serial folding of the respective parts of the partition 12. The cartridge 10 features are as described in accordance with the previous embodiments of this invention. In particular, the piston means 19 serves in the manner previously described to seal the chambers 13 and 14 so that the materials contained therein do not flow back to the push ring 24.

It should be understood that the foregoing description is only illustrative of the invention. Various alternatives and modifications can be devised by those skilled in the art without departing from the invention. Accordingly, the present invention is intended to embrace all such alternatives, modification and variances which fall within the scope of the appended claims.

What is claimed is:

1. A cartridge for simultaneously dispensing at least two different materials, said cartridge comprising:

(a) an elongated hollow housing;

(b) at least one partition within said housing extending laterally and longitudinally thereof to divide the housing into at least two chambers each for holding one of said different materials;

(c) a plunger received in said housing for movement longitudinally thereof;

(d) a dispensing orifice in said housing for each of said chambers; the plunger comprising:

(e) piston means having a first face for acting on said materials to dispense them from said housing, said piston means including means for sealingly engaging said housing and said partition;

(f) severing means following said piston means and being spaced from said materials by said piston means, said severing means being adapted to sever said partition from said housing; and (g) means for storing said severed partition so as not to interfere with the operation of said cartridge.

2. A cartridge as in claim 1 wherein said severing means comprises a push ring having cutting edges for severing said partition, said push ring supporting a second face of said piston means opposing said first face, said push ring further comprising a container comprising said means for storing said severed partition.

3. A cartridge as in claim 2 wherein said push ring cutting edges are arranged to sever said partition at longitudinal edges thereof adjacent said housing.

4. A cartridge as in claim 3 wherein means are provided within said container for coiling up said severed partition therein.

5. The cartridge as in claim 3 wherein said partition has a given thickness except at said longitudinal edges which are thinned out from said given thickness.

6. A cartridge as in claim 3 wherein said push ring is coated with a release agent to provide free movement within said housing.

7. A cartridge as in claim 3 wherein said push ring is formed of a material which is harder than the material of said partition.

8. A cartridge as in claim 3 wherein said push ring includes a forward wall for supporting said piston means, said forward wall having a slot therein through which said severed partition passes.

9. A cartridge as in claim 8 wherein said means for sealingly engaging said housing and said partition comprises edges of said piston means configured to prevent said materials being dispensed from flowing to said push ring.

10. A cartridge for simultaneously dispensing at least two different materials, said cartridge comprising:

(a) an elongated hollow housing;

(b) at least one partition within said housing extending laterally and longitudinally thereof to divide the housing into at least two chambers each for holding one of said different materials;

(c) a plunger received in said housing for movement longitudinally thereof;

(d) a dispensing orifice in said housing for each of said chambers; said plunger comprising:

(e) piston means having a first face for acting on said materials to dispense them from said housing, said piston means including means for sealingly engaging said housing and said partition;

(f) severing means following said piston means and being spaced from said materials by said piston means, said severing means being adapted to sever said partition from said housing; and (g) means for directing said severed partition into an unoccupied space within said housing so as not to interfere with the operation of said cartridge.

11. A cartridge as in claim 10 wherein said severing means comprises a push ring having cutting edges for severing said partition, said push ring supporting a second face of said piston means opposing said first face.

12. A cartridge as in claim 11 wherein said push ring cutting edges are arranged to sever said partition at the longitudinal edges thereof adjacent said housing.

13. A cartridge as in claim 12 wherein said means for directing said partition comprises means supported by said push ring for guiding said partition laterally around a periphery of said push ring so that said partition is stored adjacent an internal longitudinal wall of said housing.

14. A cartridge as in claim 13 wherein said severing means further includes a cutting edge arranged to sever said partition into at least two parts.

15. A cartridge as in claim 14 wherein said push ring is coated with a release agent to provide free movement in said housing.

16. A cartridge as in claim 15 wherein said push ring is formed of a material which is harder than the material of said partition.

17. A cartridge as in claim 16 wherein said means for sealingly engaging said housing and said partition comprises edges of said piston means configured to prevent said materials being dispensed from flowing to said push ring.

18. A cartridge for simultaneously dispensing at least two different materials, said cartridge comprising:

(a) an elongated hollow housing;

(b) at least one partition within said housing extending laterally and longitudinally thereof to divide the housing into at least two chambers each for holding one of said different materials;

(c) a plunger received in said housing for movement longitudinally thereof;

(d) a dispensing orifice in said housing for each of said chambers; said plunger comprising:

(e) piston means having a first face for acting on said materials to dispense them from said housing, said piston means including means for sealingly engaging said housing and said partition;

(f) slitting means following said piston means and being spaced from said material by said piston means, said slitting means being adapted to slit said partition into at least two parts which remain attached to said housing; and (g) means for overlapping said parts of said partition and directing said parts of said partition into an unoccupied space within said housing so as not to interfere with the operation of said cartridge.

19. A cartridge as in claim 18 wherein said slitting means comprises a push ring having at least one cutting edge for slitting said partition longitudinally and intermediate its longitudinally edges.

20. A cartridge as in claim 19 wherein said partition has a non-planar cross-section transversely of said housing.

21. A cartridge as in claim 20 wherein said partition has a U-shaped cross-section.

22. A cartridge as in claim 21 wherein said slitting means slits said partition approximately in half wherein said means for overlapping said parts of said partition and directing said parts of said partition comprises means for first folding a first half of said partition and for then folding the other half of said partition and for directing said half in an overlapped folded relationship around a periphery of said push ring so that said halves of said partition are stored adjacent an internal longitudinal wall of said housing.

23. A cartridge as in claim 22 wherein said push ring is coated with a release agent to provide free movement within said housing.

24. A cartridge as in claim 23 wherein said push ring is formed of a material which is harder than the material of said partition.

25. A cartridge as in claim 24 wherein said means for sealingly engaging said housing and said partition comprises edges of said piston means configured to prevent said materials being dispensed from flowing to said push ring.

* * * * *